US005615648A

United States Patent [19]

Ruoff et al.

[11] Patent Number: 5,615,648

[45] Date of Patent: Apr. 1, 1997

[54] ELECTRO-HYDRAULIC ADJUSTING DEVICE

[75] Inventors: Manfred Ruoff, Möglingen; Helmut Rembold, Stuttgart, both of Germany

[73] Assignee: Robert Bosch GmbH, Stuttgart, Germany

[21] Appl. No.: 691,196

[22] Filed: Aug. 5, 1996

Related U.S. Application Data

[63] Continuation of Ser. No. 373,320, filed as PCT/DE93/00608, Jul. 8, 1993, abandoned.

[30] Foreign Application Priority Data

Jul. 25, 1992 [DE] Germany ..... 42 24 653.9

[51] Int. Cl.[6] ..... F01L 1/34; F15B 11/16; F15B 11/22

[52] U.S. Cl. ..... 123/90.17; 123/90.31; 74/568 R; 464/2; 464/160; 91/417 R; 91/524

[58] Field of Search ..... 123/90.15, 90.17, 123/90.31; 74/568 R; 464/1, 2, 160; 91/235, 321, 417 R, 524

[56] References Cited

U.S. PATENT DOCUMENTS

| | | | |
|---|---|---|---|
| 3,896,704 | 7/1975 | Barud et al. | 91/524 |
| 3,967,534 | 7/1976 | Cryder et al. | 91/524 |
| 4,768,420 | 9/1988 | Korthaus | 91/417 R |
| 5,170,756 | 12/1992 | Szodfridt | 123/90.31 |
| 5,421,294 | 6/1995 | Ruoff et al. | 123/90.17 |

FOREIGN PATENT DOCUMENTS

| | | |
|---|---|---|
| 1262883 | 3/1968 | Germany . |
| 61-96112 | 5/1986 | Japan . |
| 91/10813 | 7/1991 | WIPO . |

*Primary Examiner*—Weilun Lo
*Attorney, Agent, or Firm*—Edwin E. Greigg; Ronald E. Greigg

[57] ABSTRACT

The electrohydraulic adjusting device for actuating a device for adjusting at least one camshaft of an internal combustion engine relative to its crankshaft has two differential pistons each of which serves to adjust a camshaft (intake camshaft or exhaust camshaft). Each of the two differential pistons have a small effective piston surface which is acted upon with pressure by a pump. An independent pressure control valve is associated with each of the pressure chambers on a larger effective piston surface, via which valve, the pressure in this pressure chamber can be controlled independently of the other differential piston.

3 Claims, 2 Drawing Sheets

ELECTRO-HYDRAULIC ADJUSTING DEVICE

This is a continuation of application Ser. No. 08/373,320, filed as PCT/DE93/00608 Jul. 8, 1993 now abandoned.

BACKGROUND OF THE INVENTION

The invention is based on an electrohydraulic adjusting device for actuating a device for adjusting at least one camshaft of an internal combustion engine relative to its crankshaft. In a known electrohydraulic adjusting device of this kind, the pressure chambers of the differential cylinder, which serves as an actuating member, are acted upon by a high pressure pump. The larger of the two pressure chambers of the differential cylinder is directly acted upon by the pump pressure and the pressure in the smaller of the two pressure chambers can be varied via a control valve. The pressure in the two pressure chambers can be varied by appropriately triggering the control valve; in the stationary position of the differential cylinder or the differential piston, holding pressures are set, which are much less than those pressures necessary for an adjustment. When using an electrohydraulic adjusting device of this kind for valve control of an internal combustion engine having continuous adjustment of the intake camshaft, the full-load curve of the engine can be distinctly improved by an optimized valve-seat contact. This valve control requires a rapid adjustment of the intake camshaft relative to the crankshaft over a crankshaft angle range of about 50°. Such a rapid adjustment requires high pressure pumps having maximal pressures in the range of about 100 bar. With increasingly stringent regulations for reducing fuel consumption of fuel and for improving combustion quality and engine exhaust quality, this kind of valve control having an electrohydraulic adjusting device reaches its limits.

ADVANTAGES OF THE INVENTION

The electrohydraulic adjusting device has an advantage that with its help, a valve control of an engine is possible by means of which a further considerable improvement of the exhaust quality of the engine can be achieved. The adjustability of the second camshaft (exhaust camshaft) of the engine also makes it possible to optimize the valve-seat contact of the exhaust valves which relates to the speed and the load behavior of the engine. Two control adjustment positions of the exhaust camshaft and continuous adjustment of the exhaust camshaft relative to the crankshaft are possible by means of the characteristics set forth herein. The required hydraulic components are relatively easily put together; only a few additional components need be used.

Further advantages of the invention and advantageous embodiment variants become obvious in the following description.

BRIEF DESCRIPTION OF THE DRAWINGS

Four exemplary embodiments of the invention are further explained in the description and drawings below.

DESCRIPTION OF THE EXEMPLARY EMBODIMENTS

Figure 1:
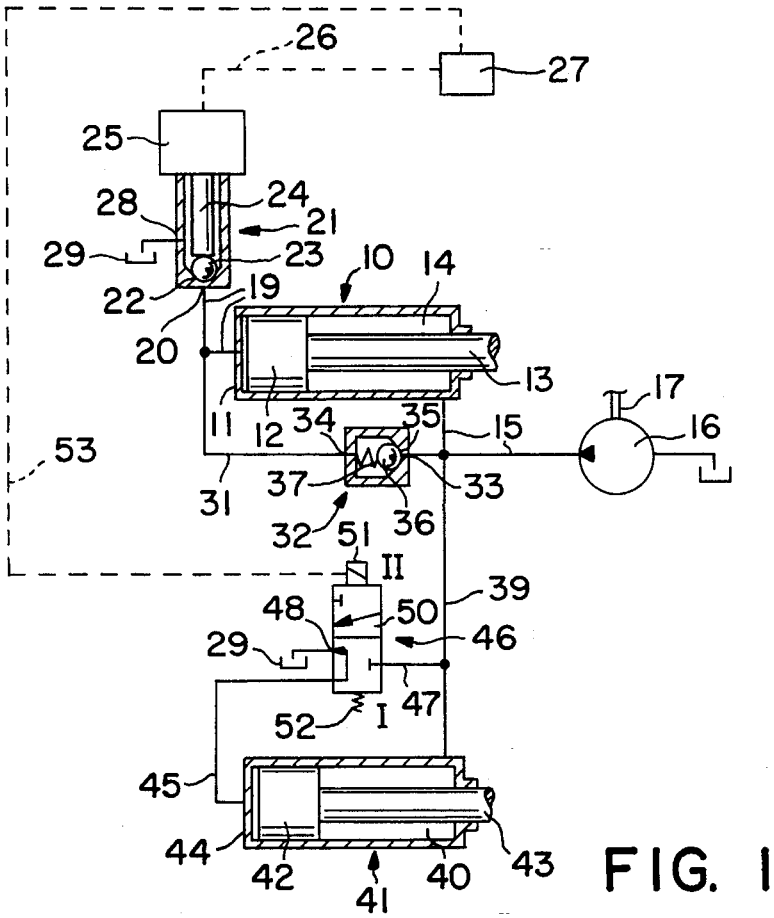
FIGS. 1–4 each show a simplified depiction of one of the four exemplary embodiments of the electrohydraulic adjusting device.

FIG. 1 shows a first exemplary embodiment of an electrohydraulic adjusting device having a differential cylinder 10 shown, whose pressure chamber 11 is separated from an annular chamber 14 by a differential piston 12 having a piston rod 13. The annular chamber 14 is continuously acted upon via a pressure line 15 by a pump 16, which is driven by a drive shaft 17, for example the camshaft of an internal combustion engine.

The pressure chamber 11 on the larger effective piston face communicates via a line 19 with the inlet 20 to an active pressure control valve 21. A valve seat 22 is embodied at this inlet 20, which seat cooperates with a valve member 23, embodied here as a ball. The tappet 24 of a proportional magnet 25, which protrudes into the pressure control valve 21, contacts the side of the valve member 23 opposite the valve seat 22. The proportional magnet 25 communicates with a control device 27 via an electric control line 26. The tappet 24 is brought into contact with the valve member 23 by a spring, not shown, which has only a slight initial tension. The magnetic force, which acts by means of a corresponding supply of current, acts on the tappet 24 in the closing direction of the valve member 23. The outlet 28 of the pressure control valve 21 communicates with a receptacle 29.

The line 15 between pump 16 and annular chamber 14 and the line 19 between pressure chamber 11 and pressure control valve 21 communicate via a connecting line 31 in which a controllable spring loaded one-way valve 32 is disposed. Thereinafter the spring loaded one-way valve will be referred to as a controllable spring loaded one-way valve. This is disposed so that its inlet 33 is acted upon from the line 15, its outlet leads to line 19 via the connecting line 31. A valve seat 35 is embodied at the inlet 33 of the controllable spring-loaded one-way valve 32, which seat cooperates with a valve member 36. This is acted upon in the closing direction by a pressure spring 37. The initial tension of the pressure spring 37 can be adjusted in a manner not shown.

Furthermore a connection line 39 branches from the line 15, which connection line 39 communicates with the annular chamber 40 of a second differential cylinder 41 having a differential piston 42 and piston rod 43. The pressure chamber 44 on the larger effective side of the piston communicates via a pressure line 45 with a 3/2-way valve 46, from which a line connection 47 leads to the connection line 39. A third connection 48 of the 3/2-way valve 46 communicates with the receptacle 29. By means of a switching magnet 51, the valve member 50 of the 3/2-way valve 46 is brought from the neutral position I to the switched position II against the action of a pressure spring 52. The switching magnet 51 communicates with the control device 27 via an electric control line 53.

In the neutral position I of the 3/2-way valve, the pressure line 45 and the third connection 48 communicate with one another while the line connection 47 is closed on one side. In comparison, in the switched position II, the line connection 47 communicates with the pressure line 45 while the third connection 48 is closed on one side. In the position II, the fluid pressure from chamber 44 is fed back to the connection line 39 which applies pressure on the chamber 4 and on the spring loaded one-way valve.

The electrohydraulic adjusting device serves to actuate a device for adjusting a camshaft of an internal combustion engine relative to its crankshaft. This adjustment produces a phase displacement of the control curves of these shafts. When using an engine having a valve control of this kind, which has a continuous adjustment of the camshaft (intake camshaft), in order to achieve an optimized full-load curve and a high exhaust quality, the camshaft is rotated in comparison with the crankshaft in a known manner to control the intake valve. A rapid adjustment is required over a relatively wide angular range (about 50° crankshaft angle). This device for adjusting the camshaft is actuated as the actuating member by the differential cylinder or the differental piston. In order to further improve the exhaust quality of the engine, moreover, a second camshaft of the engine—and in fact the one for controlling the exhaust valve—can also be rotated relative to the crankshaft. The angular range to be covered can be smaller than that of the first camshaft. The second differential cylinder 41 or the differential piston 42 is used for the relative rotation of the second camshaft (exhaust camshaft).

In the working postions of the differential cylinder 10, 41 and of the control valves (pressure valve 21 and 3/2-way valve 46), which positions are shown in FIG. 1, the first differential cylinder 10 is situated in its left end position. The intake camshaft, not shown, would thus be adjusted toward "late", i.e. to a late rotation position or valve actuation (relative to the crankshaft).

The second differential cylinder 41 is also situated in its left end position. The exhaust camshaft, not shown, would thus likewise be adjusted into a "late" rotation position. The 3/2-way valve 46 is situated in its spring-loaded neutral position I so that the pressure chamber 44 of the second differential cylinder 41 is relieved via the pressure line 45 and the 3/2-way valve 46 to the third connection 48 or the receptacle 29.

The line connection 47 is simultaneously closed so that the annular chamber 40 communicates with the pump 16 via the connection line 39 and the pressure line 15. The second differential cylinder 41 remains in its left end position or is brought to it.

The annular chamber 14 of the first differential cylinder 10 likewise communicates with the pump 16 via the pressure line 15. Moreover, there is a communication from the pressure line 15 to the pressure chamber 11 of the differential cylinder 10 and to the pressure control valve 21 via the connecting line 31, the overflow valve 32, and the line 19. The pressure control valve 21 serves as an active control element for the movement of the first differential cylinder 10, in which the pressure of the pressure chamber 11 is influenced via regulated relief via the valve seat 22 of the pressure limiting valve 21.

In the switched position of the pressure control valve 21, which position is shown and is not supplied with current, the valve ball 23 is brought into contact with the valve seat 22 by the tappet 24 of the proportional magnet. The force on the valve member 23 in the closing direction, though, is low due to the fact that the pressure spring of the proportional magnet 25, spring not shown, has only a slight initial tension. As a result, the valve member 23 readily lifts off from the valve seat 22 upon slight pressure at the inlet 20. When a predetermined counterpressure is exceeded, the pressure limiting valve 21 opens so that the pressure chamber 11 of the differential cylinder 10 is relieved. The annular chamber 14 is simultaneously acted upon by pressure which moves the differential piston 12 together with the piston rod 13 toward the left or keeps it in the left end position. In order to be able to build up the necessary pressure in the annular chamber 14 needed to move the differential piston 12 to the left, the overflow valve 32 or its pressure spring 37 must be prestressed. The opening pressure of the overflow valve 32 is set for example at 30 bar by a corresponding adjustment of the pressure spring 37. The opening cross section of the overflow valve 32, which is cleared when this opening pressure is exceeded, is calculated so that no pressure loss of any consequence occurs when there is a flow through it.

When the proportional magnet 25 of the active pressure control valve 21 is without current, the required pressure of about 30 bar (opening pressure of the overflow valve 32) builds up in the annular chamber 4 to adjust the differential cylinder to the left ("late"). When the proportional magnet 25 is not supplied with current, the initial tension of the pressure spring of the proportional magnet or of the pressure control valve 21—as already described—is very slight, so that only a very low pressure can build up in the pressure chamber 11.

To adjust the first differential cylinder 10 or differential piston 11 toward the right ("early" rotation position of the camshaft) the initial tension of the pressure spring, not shown, is increased by a corresponding triggering of the proportional magnet 25 so that the opening pressure at the inlet 20 increases. Because of the increased opening pressure of the active pressure control valve 21, the pressure also increases in the pressure chamber 11 of the differential cylinder 10. At a correspondingly high opening pressure of the active pressure control valve 21, the overflow valve 32 opens completely; the cross section which is cleared is calculated so that no pressure loss of any consequence occurs. Because of the larger effective piston surface area in the pressure chamber 11, the differential piston 12 is adjusted toward the right.

To maintain a stationary intermediate position of the differential piston 12, the pressure at the active pressure control valve 21 is just now adjusted via a corresponding excitation (reduced supply of current, triggering via control device 27) of the proportional magnet 25 so that the resulting force on the differential piston 12, from the pressures in both of the pressure chambers, now corresponds to the restoring force from the device for adjusting the intake camshaft. This restoring force or restoring moment essentially results from the reaction forces upon actuation of the cams by the camshaft and acts in opposition to the rotation direction of the camshaft, and hence toward a late rotation position. Via suitable triggering (control device 27) of the proportional magnet 25, it is likewise guaranteed that these holding pressures, even at changing camshaft speeds, are maintained at a level which is now sufficient to absorb the restoring forces from the device for adjusting the intake camshaft. The holding pressures required for this are essentially less than the adjustment pressures required for a (rapid) adjustment of the differential piston or the intake camshaft.

The annular chamber 40 of the second differential cylinder 41 is constantly acted upon via the connection line 39 by the pressure upstream of the overflow valve 32. In the depicted switched position I of the 3/2-way valve 46, the second differential cylinder 41 or differential piston 42 is brought to or kept in its left-hand (late) end position. The adjustment range of the exhaust camshaft necessary for optimizing the exhaust quality is distinctly smaller than that of the intake camshaft. That is why the adjustment velocity of the exhaust camshaft can be smaller when both camshafts have an identical adjustment time. To adjust the second differential piston 42 toward the right ("early" rotation position of the exhaust camshaft), the 3/2-way valve is switched to its switched position II by triggering the electromagnet 51. The pressure chamber 44 is likewise acted upon by the pressure in the connection line 39 or the pressure upstream of the overflow valve 32. Due to the larger effective piston face, the differential piston 42 is adjusted to its right-hand end position.

Figure 2:
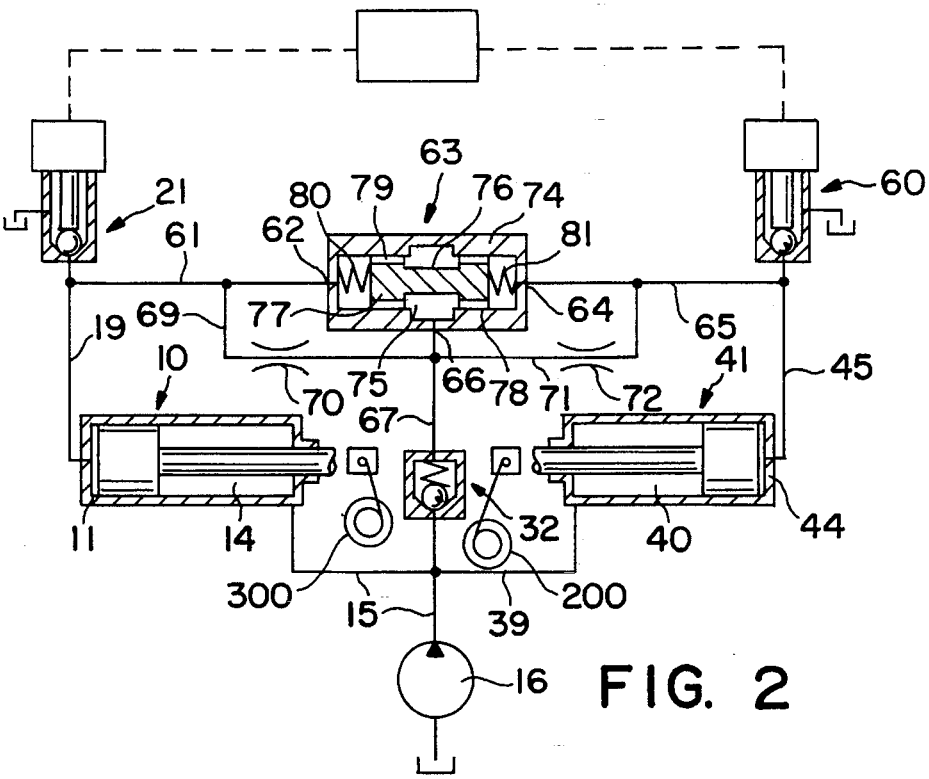

The pressures acting to adjust the second differential cylinder 41 correspond at least to the opening pressure of the overflow valve 32 (30 bar) and are sufficient for the required adjustment velocity. Due to operating conditions as a result of an appropriate triggering of the pressure control valve 21, if a higher pressure prevails upstream of the overflow valve 32, the adjustment of the differential piston 42 or of the exhaust camshaft is effected faster, which is not a disadvantage for the motor function. An adjusting means for adjusting the cam shaft of the engine relative to the crankshaft is shown in FIG. 2.

With the electrohydraulic adjusting device shown in FIG. 1, a two positional adjustment of the exhaust camshaft is achieved. In the neutral position I of the 3/2-way valve, the exhaust camshaft is adjusted to its "late" end position and when the 3/2-way valve 46 is switched (switched position II), the exhaust camshaft is adjusted to its "early" end rotation position.

By means of the described embodiment of the electrohydraulic adjusting device and that of the on-off valves (pressure valve 21, 3/2-way valve 46), an emergency operation of the motor is guaranteed, even if the proportional magnet 25 or the switching magnet 51 or the hydraulic supply breaks down. If the proportional magnet 25 breaks down, the valve member 23 of the active pressure control valve 21 is acted upon in the closing direction due only to the slight initial stress of the pressure spring correspondingly only a slight pressure can build up in the pressure chamber 11—as previously described. Thus the pressure being built up in the annular chamber 14 moves the differential piston 12 to the left end position ("late" rotation position of the intake camshaft). If the switching magnet 51 breaks down, the 3/2-way valve 46 is switched to its neutral position I due to the action of the pressure spring 52. The pressure chamber 44 is thus relieved to the receptacle 29 so that the pressure being built up in the annular chamber 40 shifts the differential piston 42 toward the left ("late" rotation position of the exhaust camshaft). If there is a loss of hydraulic supply, the differential pistons 12 or 42 are moved to the left ("late") as a result of the mechanical restoring forces from the device for adjusting the cam shaft. In both cases, emergency operation of the motor is assured, because of this restoration to the "late" rotation position of the camshafts.

In lieu of the pressure control valve 21, a 2/2-way valve can also be employed as the active control element, which valve is triggered in a clocked form by an electromagnet. The pressure regulation for the first differential cylinder 10 then takes place via the control or regulation of the volume flow.

Figure 3:
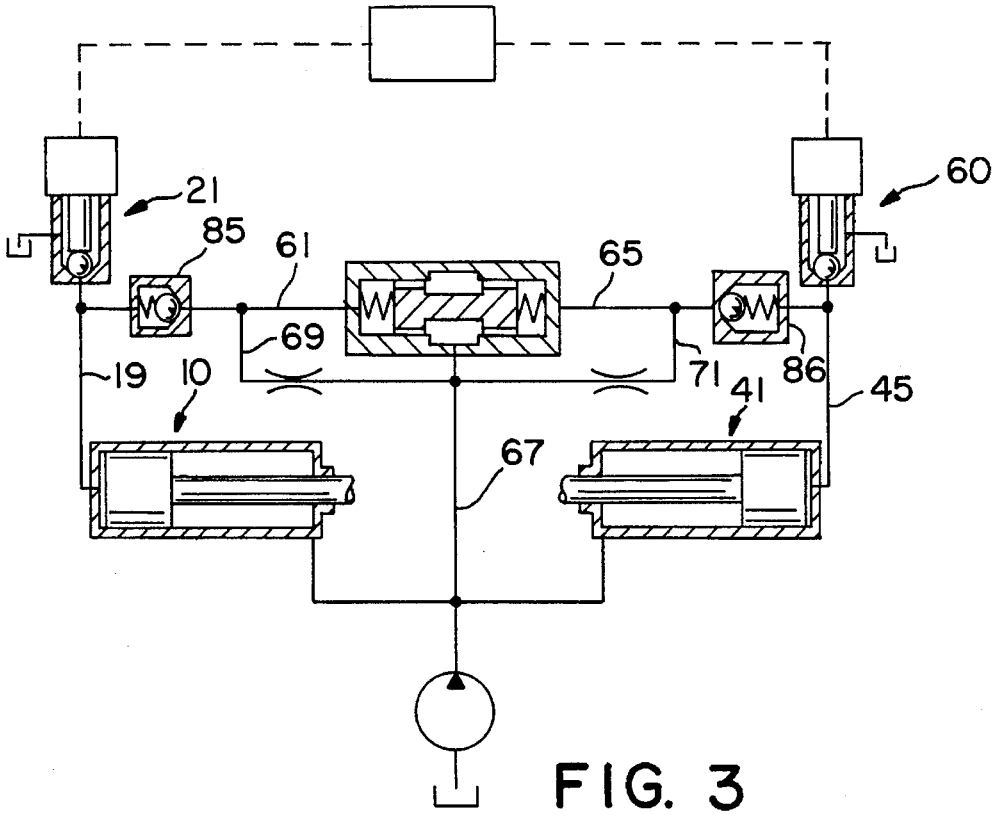
Figure 4:
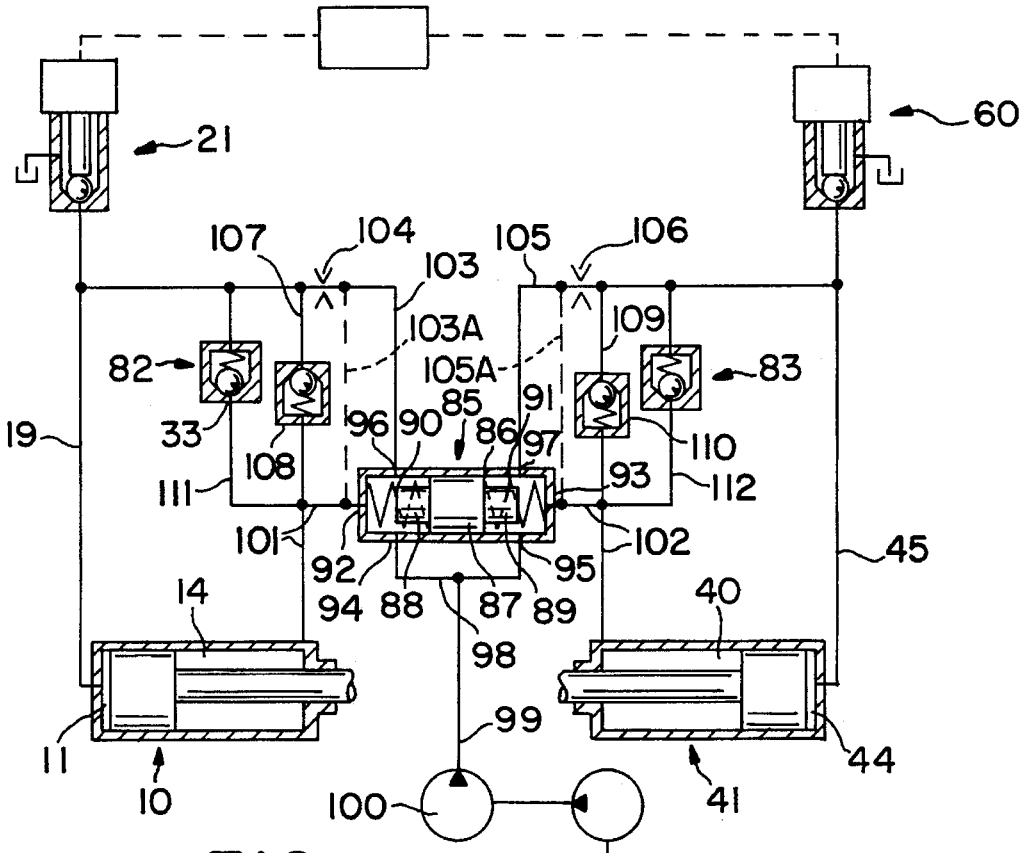

The further embodiments of the electrohydraulic adjusting device shown in FIGS. 2–4 are appropriate for a continuous adjustment of the exhaust camshaft, 200 independently of the continuous adjustment of the intake camshaft 300 or the first differential cylinder. In the second embodiment of the electrohydraulic adjusting device shown in FIG. 2, the annular chamber 14 of the first differential cylinder 10 is acted upon by the pump 16 via the pressure line 15. From the pressure line 15, the connection line 39 branches off and leads to the annular chamber 40 of the second differential cylinder 41. A line 19 leads from the pressure chamber 11 of the first differential cylinder 10 to the pressure control valve 21, whose construction corresponds to the one described in FIG. 1. The pressure chamber 44 of the second differential cylinder 41 communicates via the pressure line 45 with a second active pressure control valve 60, whose construction corresponds to that of the pressure control valve 21.

A first connecting line 61, which leads to a first outlet 62 of a flow divider 63, branches off from the line 19. A second connecting line 65 leads from the second outlet 64 of the flow divider 63 to the pressure line 45. A connection line 67 leads from the inlet 66 of the flow divider 63, which line 67 communicates with the pressure line 15 or the connection line 39 and hence with the pump 16. The overflow valve 32, whose construction and mode of operation corresponds to the one described in FIG. 1, is inserted into this connection line 67. The overflow valve 32 is inserted so as to enable a flow of pressure fluid from the pump 16 to the flow divider 63.

A first throttle line 69, which communicates with the connection line 67, branches off from the first connecting line 61, actually between the overflow valve 32 and the flow divider 63. A first throttle 70 is inserted in the first throttle line 69. A second throttle line 71, which has a second throttle 72, leads from the connection line 67 (between the overflow valve 32 and the flow divider 63) to the second connecting line 65.

The flow divider 63 has a roughly cylinder-shaped housing 74, in which a valve needle 75 is guided. This valve needle 75 has an annular groove 76 running around its middle so that a guide collar 77 or 78 remains in the region of each of its two face ends. Each of these guide collars 77 or 78 has throttle grooves 79 on its outer circumference, which connect the respective face end of the valve needle 75 with the annular groove 76. These throttle grooves 79 in the region of the guide collars 77 or 78 are cross sectionally embodied so that a defined throttle operation is achieved. The pressure drop at these throttle grooves comes to about 3 bar here in the exemplary embodiment. The valve needle 75 is centered in a middle position in the housing 74 by two pressure springs 80 or 81. The first spring 80 rests against the inside of the housing 74 in the region of the first outlet 62 and is supported on the other end on the guide collar 79 of the valve needle 75. The second pressure spring 81 rests against the second guide collar 78 of the valve needle 75 and is supported on the other end on the inside of the housing 74 in the region of the second outlet 64. The first outlet 62 and the second outlet 64 are each embodied as a valve seat, which cooperates with the guide collar 77 or 78 and at the same time serves as a stop. The inlet 66 of the flow divider is disposed about in the middle of the housing 74 and feeds into the region of the annular groove 76 of the valve needle 75.

When the control valves (pressure valve 21 and second pressure control valve 60) are not activated, the valve needle 75 of the flow divider 63 is situated in its spring-centered middle position. The pressure built up by the pump 16 increases via the overflow valve 32 and the connection line 67 at the outlet 64 of the flow divider. The volume flow produced by the pump is split up symmetrically between both of the outlets 62 or 64 via the annular groove 76 and the throttle grooves 79 in the guide collars 77 or 78. Due to the non-activated pressure control valves 21 or 60, though, no pressure of any consequence can build up in the connecting lines 61 or 65. The pressure in the line 19 or the pressure line 45 and hence in the pressure chamber 11 of the differential cylinder 10 or in the pressure chamber 44 of the second differential cylinder 41 is likewise correspondingly low. The pressure which builds up in the annular chambers 14 or 40 as a result of the action of the overflow valve 32, via the pressure line 15 or the connection line 39, moves the differential piston of the differential cylinder to its "late" end position or holds it there.

In this switched position shown of the flow divider 63, if for example the first pressure control valve 21 is activated by a corresponding triggering from the control device 27, first the flow rate by means of the first connecting line 61 is reduced. Due to the volume flow in the second connecting line 65, which is increasing as a result, a greater pressure drop is produced at the throttle grooves 79 of the right guide collar 78. As a result of this greater pressure drop on the right side, the valve needle is switched to the right until the flow rate is throttled at the second outlet 64. Due to this throttle function at the second outlet 64, a pressure can build up in the first connecting line 61 or at the first outlet 62, which pressure pushes the valve needle 75 against the right stop (second outlet 64) by impinging on its left side. The second outlet 64 is closed so that the main flow rate flows via the throttle groove 79 in the left guide collar 77 and via the second outlet 64 of the flow divider 63. The dimensions of the valve needle 75 or of the needle face ends, the cross section of the throttle grooves 79, the valve seat cross section of the outlets 62 and 64, and the initial tension of the centering springs 80 and 81 must be laid out so that this switched position of the flow divider 63 is then set whenever only one of the two pressure control valves 21 or 60 is activated. The force of the pressure springs, together with the restoring force resulting from the pressure drop at the throttle cross section, must be less than the forces acting on the respective face end due to the increasing pressure.

In the described, activated switched position of the first pressure control valve 21, if the second pressure control valve 60 is additionally triggered, a pressure is set there as a result of the bypass flow via the throttle 72, which pressure moves the valve needle 75 to the left, back toward the middle position, depending upon the pressure level. The throttle cross sections of the throttles 70 or 72 are chosen, though, so that the main volume flow takes place via the flow divider 63. Depending upon the pressures set at the first pressure control valve 21 or at the second pressure control valve 60, the valve needle 75 is adjusted so that the greater volume cross section is always cleared to the pressure control valve having the higher set opening pressure.

The pressure increase and the volume distribution takes place in an analogous manner if the second pressure control valve 60 is activated first.

With the electrohydraulic adjusting device according to FIG. 2, the courses of pressure in the two pressure circuits (pump 16, overflow valve 32, flow divider 63, pressure control valve 21, and first differential cylinder 10 or pump 16, overflow valve 32, flow divider 63, second pressure control valve 60, and second differential cylinder 41) can influence one another due to the common overflow valve 32. A pressure increase in one of the two pressure circuits (inlet pressure increase at one of the two pressure control valves) for adjusting one of the two differential cylinders can also act upon the other circuit in which the differential cylinder has just now assumed an intermediate position, for example. The resultant divergence or reaction must be balanced via the control device using control engineering. In order to avoid this, a further separation of the two pressure circuits can be carried out as described in FIG. 3.

The electrohydraulic adjusting device described in FIG. 3 distinguishes itself from the one described in FIG. 2 in that there is no overflow valve 32 in the connection line 67. Instead, an individual overflow valve is associated with each of the two pressure control valves 21 or 60 and with each of the two differential cylinders 10 or 41. A first overflow valve 85 is disposed in the first connecting line 61, actually between the discharge point in the line 19 and the connection with the first throttle line 69. A second overflow valve 86 is inserted between the second throttle line 71 and the pressure line 45 in the second connecting line 65. Both overflow valves 85 and 86 correspond in their construction and mode of operation to those in FIGS. 1 and 2. Both overflow valves 85 and 86 are inserted so that they make possible a flow of pressure fluid from the flow divider to the pressure control valve 21 or 60. The two pressure circuits are better isolated by means of these two overflow valves 85 or 86 (control of the first differential cylinder 10 or the second differential cylinder 41) so that a pressure increase in one of the two circuits (activation of one of the two pressure control valves 21 or 60) has less strong of an effect on the other differential cylinder, respectively.

The exemplary embodiment of the electrohydraulic adjusting device shown in FIG. 4 distinguishes itself from the two previously described primarily by means of the embodiment of the flow divider. The flow divider 85 has a cylindrical housing 86, in which a piston 87 is guided. This piston 87 has a shoulder 88 or 89, which has a small diameter, on each of its two face ends. The one end of a pressure spring 90 or 91, which encompasses the appropriate shoulder 88 or 89, is supported on each of the face ends of the piston 87. The other end of each pressure spring 90 or 91 rests against the adjacent face end of the housing 86. A first outlet 92, and on the opposite (right-hand) end, a second outlet 93 are disposed in these face ends. These two outlets 92 or 93 are embodied as valve seats and at the same time serve as stops for the piston or the shoulders 88 or 89. Furthermore, two radial inlets 94 or 95, of which the first input 94 is disposed in the region of the shoulder 88 and the second inlet 95 is disposed in the region of the shoulder 89, feed into the housing 86 of the flow divider 85. Two further outlets are disposed approximately radially on the other side, of which the third outlet 96 is opposite the first inlet 94. The fourth outlet 97 is opposite the second inlet 95. The two inlets 94 and 95 communicate with one another by means of an inlet line 98, which in turn communicates with a pump 100 via a pressure line 99.

The first ouput 92 communicates via a first pressure line 101 with the annular chamber 14 of the first differential cylinder 10. The second outlet 93 correspondingly communicates via a second pressure line 102 with the annular chamber 40 of the second differential cylinder 41. The pressure chamber 11 of the first differential cylinder 10 communicates with the pressure control valve 21 via the line 19. Correspondingly, the pressure chamber 44 of the second differential cylinder 41 communicates with the second pressure control valve 60 via the pressure line 45. A first line connection 103, in which an orifice 104 is disposed, leads from the third outlet 96 to the line 19 and is connected to it. Correspondingly, a second line connection 105 having an orifice 106 leads from the fourth outlet 97 to the pressure line 45 and is likewise connected to it. A first branch line 107 leads from the first connecting line 103 between the first orifice 104 and the line 19, and on the other end is connected to the first pressure line 101.

A first spring-loaded check valve 108 is disposed in this first branch line 107, which valve makes possible a flow of pressure fluid from the first line connection 103 to the first pressure line 101. The second line connection 105 analogously communicates with the second pressure line 102 via a second branch line 109. A corresponding second check valve 110 is likewise disposed in this second branch line 109, which valve makes possible a flow of pressure fluid from the second line connection 105 to the second pressure line 102.

A further branch leads from the first pressure line 101 to the first line connection 103 and discharges between the line 19 and the discharge point of the first branch line 107. The overflow valve 82, whose inlet 33 is oriented toward the first pressure line 101, is disposed in this first branch 111. The second pressure line 102 analogously communicates with the second line connection 105 by means of a second branch 112. The second overflow valve 83 is correspondingly disposed in this second branch 112. In a variation of the exemplary embodiment, the first line connection 103 can also branch off from the pressure line 101 in the form of a line connection 103A (shown in dashed lines), thus obviating the need for the third outlet 96 of the flow divider 85 and the first branch line 107 having the first check valve 108. Correspondingly, a second branch line 105A can lead from the pressure line 102, thus obviating the need for the fourth outlet 97 of the flow divider and the second branch line 109 having the second check valve 110.

In the switched position shown in FIG. 4, both of the differential cylinders 10 and 41 are situated in their respective "late" end positions, the flow divider 85 is situated in its spring-centered middle position. The annular chamber 14 of the first differential cylinder 10 is acted upon by the pump 100 via the first pressure line 101, the second outlet 92, the inner chamber of the flow divider 85, as well as the first inlet 94, the inlet line 98, and the pressure line 99. Correspondingly, the annular chamber 40 of the second differential cylinder 41 is acted upon by the pump 100 via the second pressure line 102, the second outlet 93, the inside of the flow divider 85, the first inlet 89, as well as the inlet line 98 and the pressure line 99.

The two pressure control valves 21 and 60 are not activated so that—as described above in the exemplary embodiments—no high pressure can build up in the pressure chambers 11 and 44 of the differential cylinders 10 and 41. In comparison, a sufficient pressure can build up in the annular chambers 14 and 40 due to the disposition of the overflow valves 82 and 83 and the disposition of the first orifice 104 or the second orifice 106. If for example the first pressure control valve 21 is now triggered so that the predetermined opening pressure at the overflow valve 82 is exceeded, the piston 87 of the flow divider 85 is moved to the right due to the pressure building up at the first outlet 92. The piston 87 moves to the right until the second outlet 93 or the corresponding valve seat is closed by the shoulder 89 of the piston 87. Hence only a relatively low volume flow can reach the second differential cylinder 41 or the second pressure control valve 60 via the fourth outlet 97 and the second orifice 106. The main volume flow is consequently available for controling the first differential cylinder 10, which is moved in the respective actuation direction or held in the stationary position by triggering the first pressure control valve 21, analogous to the above described exemplary embodiments.

If the second outlet 93 of the flow divider 85 is closed by the piston 87, the pressure fluid volume is enclosed in the annular chamber 40 of the second differential cylinder 41 due to the action of the second check valve 110 and the action of the second overflow valve 83 so that a movement of the differential piston in the "early" actuation direction until the overflow valve 83 opens is prevented. The second differential cylinder 41 is therefore moved to its "late" end position or is held there. If the differential cylinder is to be held in an arbitrary intermediate position, a corresponding counterpressure must be built up in the pressure chamber 44 by a corresponding triggering of the second pressure control valve 60. If the differential piston of the second differential cylinder 41 is shifted from an arbitrary intermediate position to a "late" position, the opening pressure of the second pressure control valve 60 is correspondingly reduced. The annular chamber 40 can be correspondingly acted upon by pressure fluid via the second check valve 110. This happens on the one hand via a volume exchange between pressure chamber 44 and check valve 110 and on the other hand via an influx of pressure fluid from the fourth outlet 97 of the flow divider via the orifice 106. Such an actuation of the differential piston additionally supports the restoring function of the device for actuating the camshaft.

If a movement of the second differential cylinder 41 toward the "early" actuation direction from the maintained position or from an actuation toward "late" is carried out, by means of corresponding triggering of the second pressure control valve 60, its opening pressure is increased so that the influx from the fourth outlet 97 via the second line connection 105 and the second orifice 106 is stemmed and the piston 87 of the flow divider 85 is moved to the left. At the same time as this, the second outlet 93 opens so that the annular chamber 40 as well as the overflow valve 83 is acted upon by pressure.

When the opening pressure of the overflow valve 83 is exceeded, the pressure chamber 44 is simultaneously acted upon by the corresponding pump pressure so that an actuation ensues as a result of the larger effective piston surface.

If both differential cylinders 10 or 41 are brought from a "late" actuation position to an "early" one, the greater volume flow is apportioned via the flow divider 85 to the differential cylinder which exerts the greater actuation force. Due to the greater counteracting pressure at the first or second outlet 92 or 93, arising as a result of the greater actuation force, the piston 87 is deflected so that throttling occurs accordingly on the connection side of the outlet having the lower pressure. This volume distribution function can be varied accordingly by triggering one of the two pressure control valves, 21 or 60. The foregoing relates to preferred exemplary embodiments of the invention, it being understood that other variants and embodiments thereof are possible within the spirit and scope of the invention, the latter being defined by the appended claims.

We claim:

1. An electrohydraulic adjusting system for actuating a device for adjusting at least one camshaft of an internal combustion engine relative to a crankshaft of the engine, having a first differential cylinder (10), said first differential cylinder including a pressure chamber (11) separated by a piston from an annular chamber (14), a pump that pumps fluid under pressure, said piston having a smaller piston surface in said annular chamber (14) that is acted upon with pressure fluid by said pump (16, 100), while a pressure in said pressure chamber (11) on a larger piston surface is varied by means of a first electromagnetically actuatable control valve (21) which communicates with said pressure chamber (11), a second differential cylinder (41), said second differential cylinder including a second pressure chamber (44) separated by a second piston from a second annular chamber (40), said second piston having a small piston surface in said second annular chamber (40) that is acted upon with pressure fluid by the pump (16, 100), in which the pressure in the second pressure chamber (44) on a larger effective piston surface than the small piston surface of the second piston is varied via a second electromagnetically actuatable control valve (46, 60), and a second camshaft of the engine is adjusted relative to a said crankshaft by use of said second differential piston (42) wherein first and second electromagnetically actuatable control valves (21, 46, 60) communicate with each other and the pump via a flow dividing valve (63, 85).

2. The electrohydraulic adjusting device according to claim 1, in which at least one throttle device (70, 72) is placed in parallel with said flow dividing valve (63, 85).

3. The electrohydraulic adjusting device according to claim 1, in which at least one controllable spring loaded one-way valve (32) is disposed between said pump (16, 100) and one of said first and second electromagnetic actuatable control valves (21 or 60).

* * * * *